US009514865B2

(12) United States Patent
Schmutz et al.

(10) Patent No.: US 9,514,865 B2
(45) Date of Patent: Dec. 6, 2016

(54) MULTI-CONTACT ELEMENT FOR A VARISTOR

(71) Applicant: PHOENIX CONTACT GMBH & CO. KG, Blomberg (DE)

(72) Inventors: Jan-Erik Schmutz, Detmold (DE); Friedrich-Eckhard Brand, Barntrup (DE)

(73) Assignee: Phoenix Contact GMBH & Co. KG (DE)

( * ) Notice: Subject to any disclaimer, the term of this patent is extended or adjusted under 35 U.S.C. 154(b) by 101 days.

(21) Appl. No.: 14/547,388

(22) Filed: Nov. 19, 2014

(65) Prior Publication Data

US 2015/0170806 A1 Jun. 18, 2015

(30) Foreign Application Priority Data

Nov. 20, 2013 (DE) ..... 10 2013 223 648

(51) Int. Cl.
*H01C 7/10* (2006.01)
*H01C 7/12* (2006.01)
(Continued)

(52) U.S. Cl.
CPC ..... *H01C 7/126* (2013.01); *H01C 1/084* (2013.01); *H01C 1/14* (2013.01); *H01C 1/142* (2013.01);
(Continued)

(58) Field of Classification Search
CPC ..... H01C 7/12; H01C 7/102; H01C 7/123; H01C 7/126; H01C 7/13
(Continued)

(56) References Cited

U.S. PATENT DOCUMENTS 7,572,682 B2 * 8/2009 Yang ..... H01L 23/5252 257/529
7,732,922 B2 * 6/2010 Yang ..... H01L 23/5226 257/751
(Continued)

FOREIGN PATENT DOCUMENTS

DE 751182 A 3/1953
DE 102009049076 A1 4/2011
DE 102012011241 A1 12/2013

OTHER PUBLICATIONS

DE 102012011241, machine translation, Jun. 2012.*
(Continued)

*Primary Examiner* — Kyung Lee
(74) *Attorney, Agent, or Firm* — Sheridan Ross P.C.

(57) ABSTRACT

The object of the invention is a multi-contact element for a varistor wherein the multi-contact element has a sandwich structure, wherein the sandwich structure has two or more contact elements in a lowermost layer, and wherein the sandwich structure has at least one common connection electrode in an uppermost layer, wherein a first intermediate layer made of an electrically insulating layer of material is provided at least in segments between the lowermost layer (US) and the uppermost layer, wherein fuses are located in the first intermediate layer that are configured such that they are capable of sustaining a specified surge current, the specified surge current per fuse being less than the specified surge current of the varistor, wherein the fuses are embodied as vias within the first intermediate layer, wherein the fuses in the first intermediate layer are in direct electrical contact with the common connection electrode, wherein each of the fuses is in direct or indirect electrical contact with a subset of the contact elements (KE1, KE2), wherein the fuses provide blow-out channels in the first intermediate layer so that in the event of a thermal overloading of a fuse of the first
(Continued)

Figure 1:
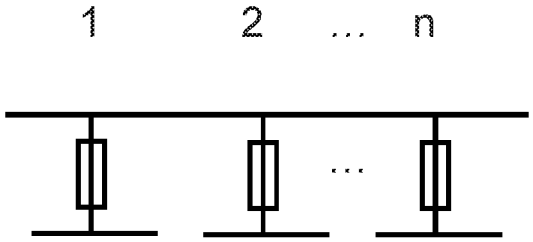

intermediate layer, the affected fuse can vaporize through the blow-out channel.

12 Claims, 7 Drawing Sheets

(51) Int. Cl.

| | |
|---|---|
| ***H01C 1/084*** | (2006.01) |
| ***H01C 1/142*** | (2006.01) |
| ***H01H 85/12*** | (2006.01) |
| ***H01C 1/14*** | (2006.01) |
| ***H01C 7/108*** | (2006.01) |
| ***H01H 85/02*** | (2006.01) |
| *H01C 7/102* | (2006.01) |

(52) U.S. Cl.
CPC ..... *H01C 7/108* (2013.01); *H01H 85/0241* (2013.01); *H01H 85/12* (2013.01); *H01C 7/102* (2013.01)

(58) Field of Classification Search
USPC ..... 338/21
See application file for complete search history.

(56) References Cited

U.S. PATENT DOCUMENTS

| | | | | |
|---|---|---|---|---|
| 8,058,966 | B2 * | 11/2011 | Koyama | H01C 1/1406 219/553 |
| 2006/0278895 | A1 * | 12/2006 | Burr | H01L 23/5252 257/209 |
| 2007/0222028 | A1 * | 9/2007 | Matsuoka | H01L 23/5256 257/529 |
| 2009/0302416 | A1 * | 12/2009 | Abou-Khalil | H01L 23/5256 257/529 |
| 2010/0252908 | A1 * | 10/2010 | Schlarmann | H01L 23/5256 257/529 |
| 2012/0326269 | A1 * | 12/2012 | Bonilla | H01L 23/5226 257/529 |

OTHER PUBLICATIONS

DE 102009049076, machine translation, Oct. 2009.*
Search Report prepared by German Patent Office on Aug. 22, 2014, for German Application No. 10 2013 223 648.4.

* cited by examiner

MULTI-CONTACT ELEMENT FOR A VARISTOR

The invention relates to a multi-contact element for a varistor.

Varistors provide a voltage-independent resistance in electrical circuits. Varistors are therefore used in a wide range of applications, typically in order to discharge overvoltage above a certain threshold voltage, thus preventing the overloading or damaging of a subsequent device. It is for this reason that varistors are frequently also referred to synonymously as overvoltage protection devices. One example of such overvoltage is voltage that can occur as a result of lightning. If such an overvoltage event occurs, it is the task of the varistor to discharge the current past the respective appliance connected electrically downstream, thus limiting the voltage at the electrical appliance.

The varistor generally contains a granular metal oxide, e.g., zinc oxide and/or bismuth oxide and/or manganese oxide and/or chromium oxide and/or silicon carbide, which is almost always inserted in the form of (sintered) ceramic between two planar electrodes as supply elements.

Typically, the individual grains possess varying conductivity. Boundary layers are formed at the respective grain boundaries, that is, at the contact points of the grains. It can be determined that, as the thickness increases, the number of grain boundaries increases, and hence the threshold voltage as well. If voltage is applied to the supply elements, an electrical field is formed. Depending on the voltage, the boundary layers are broken down and the resistance decreases.

Due to the material characteristics of the varistor, neither the distribution of current nor the breakdown of the boundary layers is a uniform process; rather, localized current paths are formed that reach the conductive state at different speeds.

As a result of the material characteristics, and due to the use of the varistor, leakage currents occur. While these leakage currents are very usually small, they can lead in some circumstances to substantial heating of the component, thus posing a fire hazard. To counteract this, a temperature sensor is typically used which actuates a switch when a certain temperature is exceeded. However, temperature sensors can only be used to detect slow events. Quick heating such as that which occurs when a high voltage is applied, for example, leads to a greatly delayed rise in temperature at the temperature sensor due to the necessary and known slow heat conductance, so that the varistor would generally already be destroyed. The selectivity is also generally limited here; that is, only small currents can be cut off.

Such an energy input can occur, for example, as a result of overvoltage occurring over an extended period, thus leading to an interconnection of the varistor, upon which the short-circuit current of the network is discharged via the varistor. In this case, substantial heating of the varistor occurs, and there is a fire hazard. Furthermore, the varistor can be damaged in this way to the extent that the varistor is explosively shorted out.

Varistors are therefore typically provided with an upstream fuse.

Previously, standard fuses connected upstream from the respective overvoltage protection device were used for this purpose. In doing so, however, two contradictory basic conditions had to be reconciled: While a high level of current flows temporarily during an overvoltage event that should not trigger the fuse, a level of current that is as low as possible must reliably trigger it if damage to the overvoltage protection device is imminent.

That is, in order to ensure rapid cut-out of the overvoltage protection device in the event of a fault, i.e., at low fault currents, a fuse with a lower rating would need to be used. However, due to the $I^2t$ value associated therewith, such a fuse sustains only small impulse currents. Conversely, however, in order to enable discharge of a large impulse current, the fuse must have a higher rating.

Nonetheless, damage occurs in varistors time and time again that cannot be detected by the abovementioned elements, that is, currents occur that can no longer be shunted off by the selectivity of the thermal cut-out but that are too small for an upstream fuse.

In view of this background, there is a desire to minimize the fuse rating of the upstream fuse while maintaining maximum surge withstand current.

Previous solutions for resolving this problem have been unsatisfactory.

One initial approach for resolving this problem was described in DE 10 2012 011 241.6. A division of the currents into parallel paths is proposed therein in order to thus reduce the rating of the individual fuses.

Although the proposed solution does fulfill its task, it would be desirable to find a solution that is easily tunable while enabling smaller installation sizes and that is also easy to manufacture.

It is the object of the invention to provide a contact element for a varistor that avoids one or more of these drawbacks.

This object is achieved by the features of claim 1. Advantageous developments are also the subject of the dependent claims.

The invention is described below in further detail with reference to the enclosed drawings based on preferred embodiments.

Figure 2:
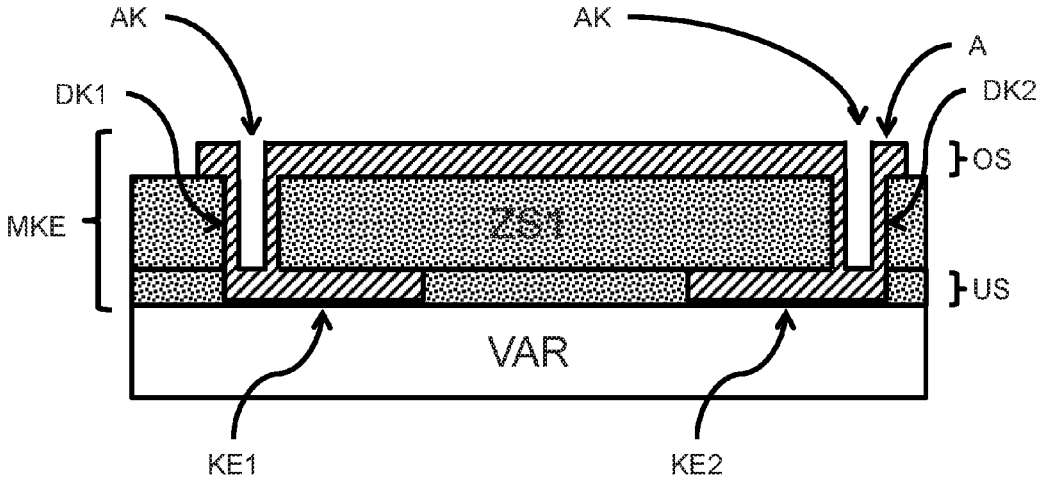
Figure 3:
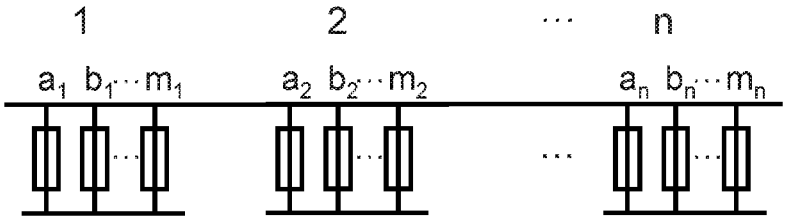
Figure 4:
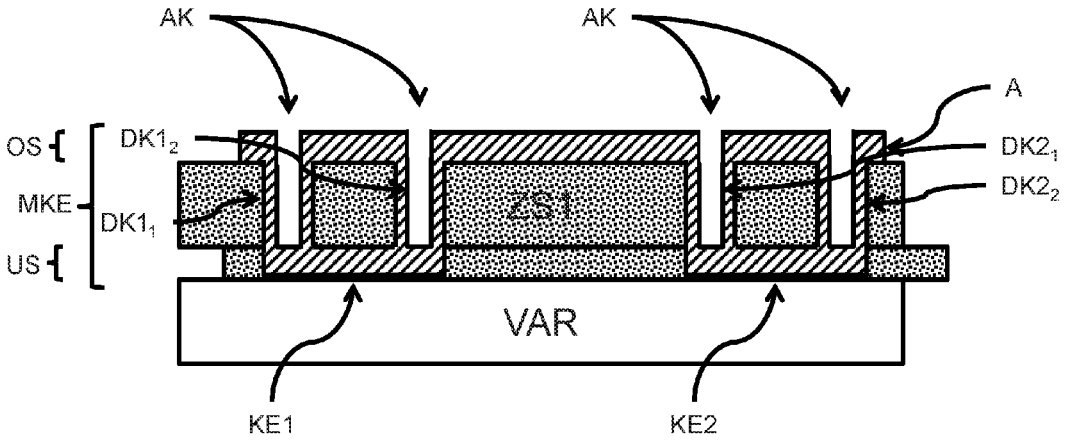
Figure 5:
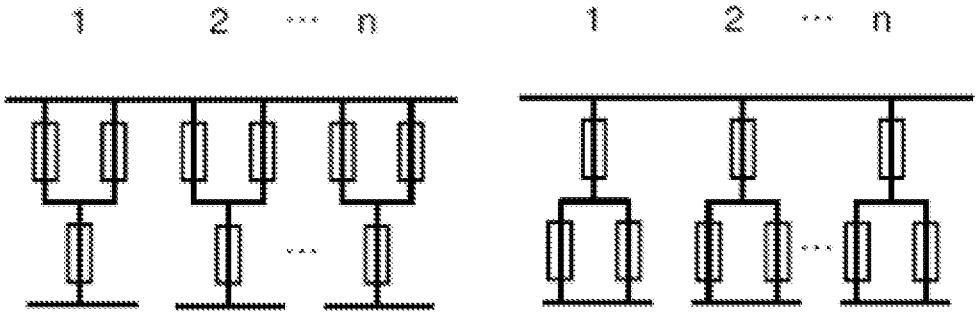
Figure 6:
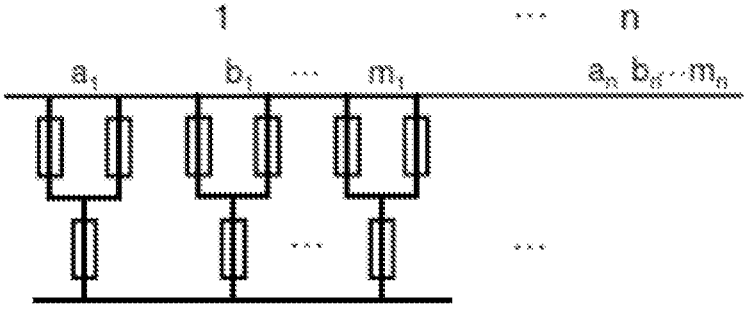
Figure 7:
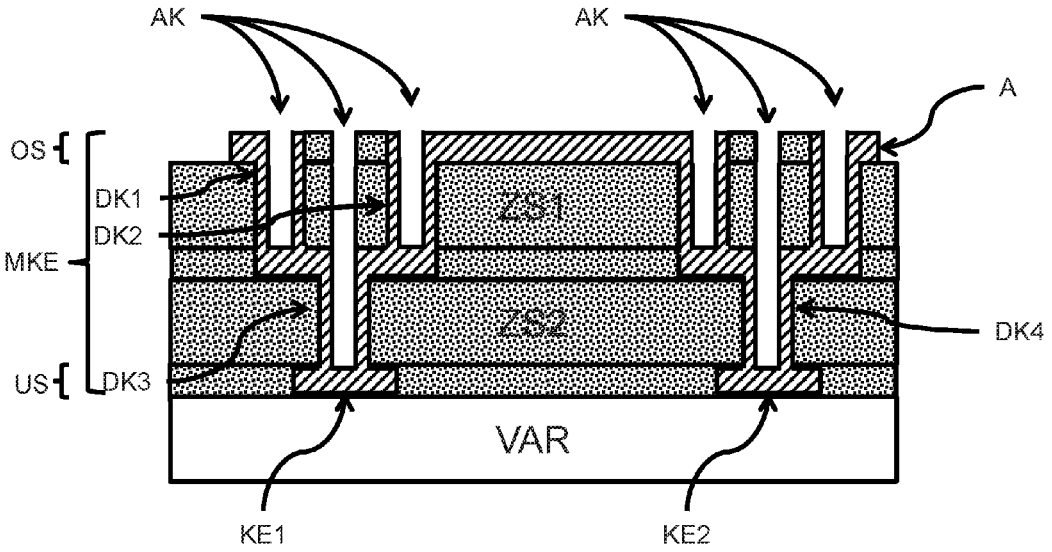
Figure 8:
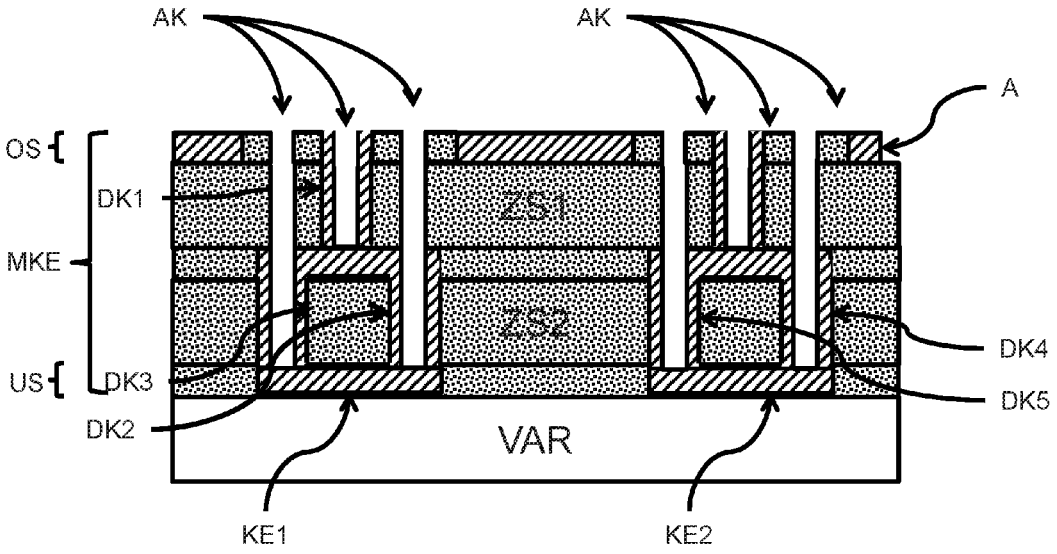
Figure 9:
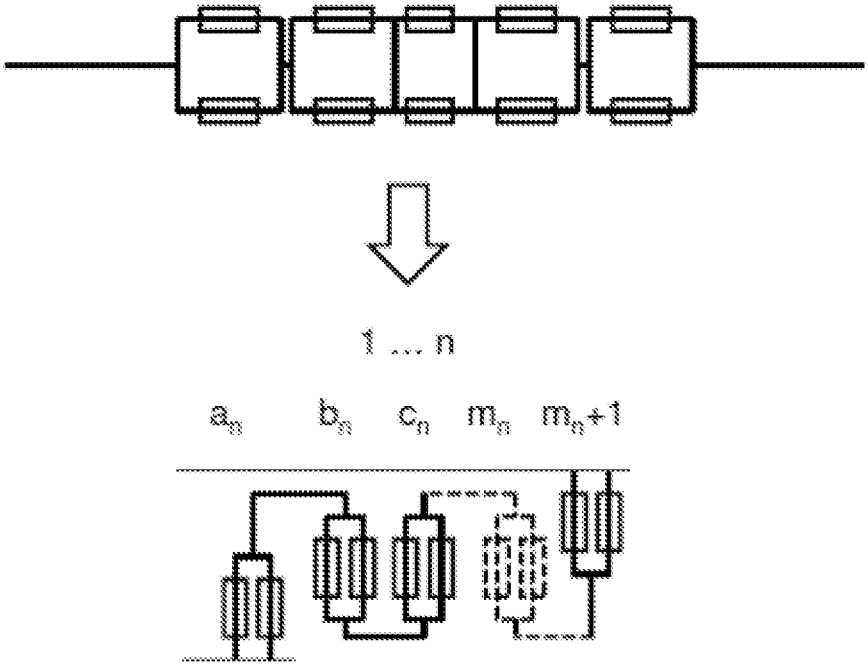
Figure 10:
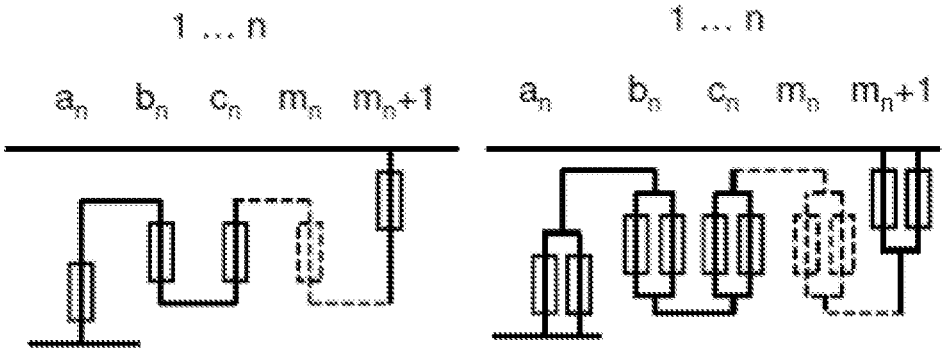
Figure 11:
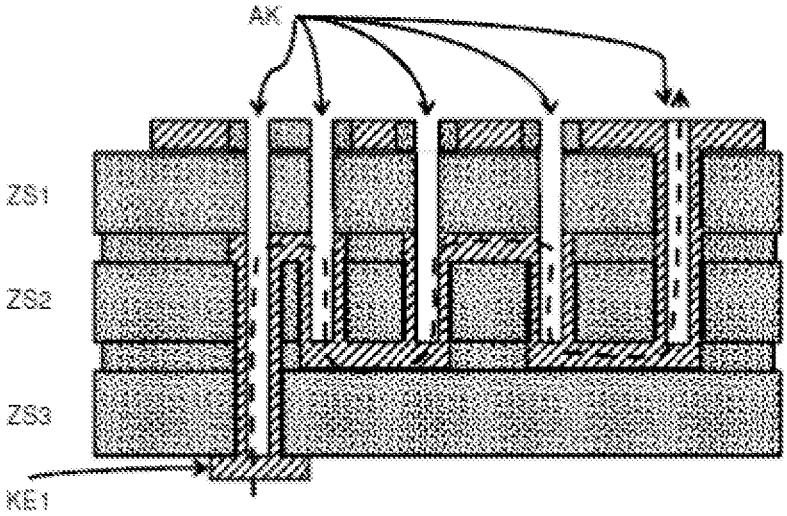
Figure 12:
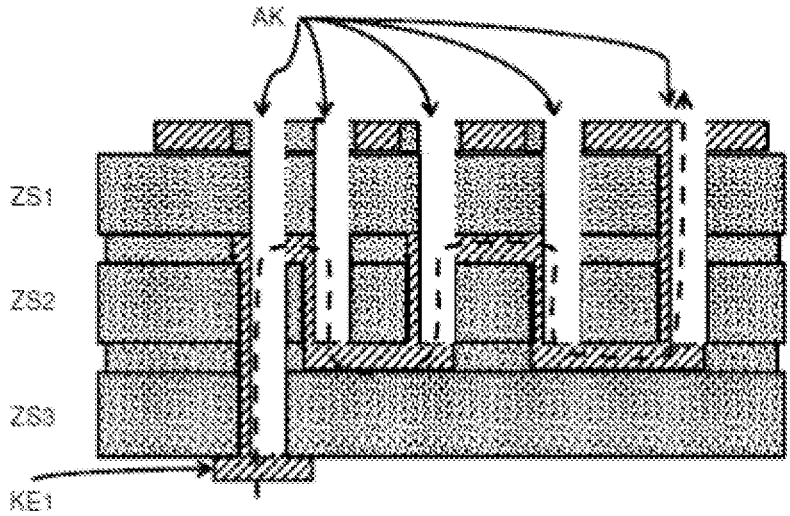
Figure 13:
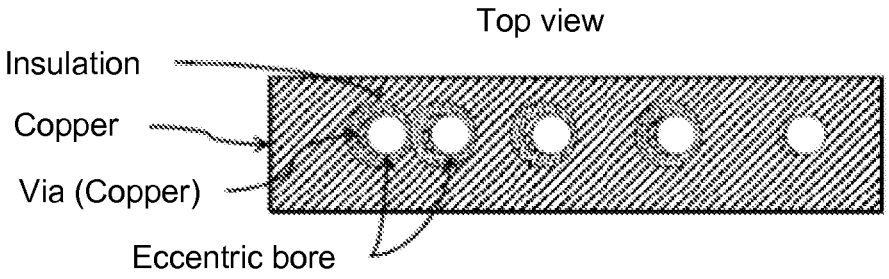

FIG. 1 shows a schematic equivalent circuit diagram of one aspect of the invention, FIG. 2 shows a section through one exemplary arrangement according to embodiments of the invention, FIG. 3 shows a schematic equivalent circuit diagram of another aspect of the invention, FIG. 4 shows a section through another exemplary arrangement according to embodiments of the invention, FIG. 5 shows schematic representations of equivalent circuits according to one aspect of the invention, FIG. 6 shows a schematic equivalent circuit diagram of yet another aspect of the invention, FIG. 7 shows a section through another exemplary arrangement according to embodiments of the invention, FIG. 8 shows a section through another exemplary arrangement according to embodiments of the invention, FIG. 9 shows a schematic equivalent circuit diagram and a corresponding quasi-spatial arrangement according to another aspect of the invention, FIG. 10 shows a schematic equivalent circuit diagram in a quasi-spatial arrangement according to another aspect of the invention, FIG. 11 shows a section through another exemplary arrangement according to embodiments of the invention, FIG. 12 shows a section through another exemplary arrangement according to embodiments of the invention, and FIG. 13 shows a top view of FIG. 12.

The invention makes use of the fact that the shorting-out of a varistor is generally initially a localized phenomenon that only later affects the varistor as a whole.

The invention therefore proposes the subdivision of the fuse into individual fuses 1, 2, . . . n, as shown in FIG. 1, which contact a varistor in a parallel manner. A corresponding exemplary construction is shown in FIG. 1. A multi-contact element MKE is used as a varistor VAR, the multi-contact element MKE having a sandwich structure. In a lowermost layer US, the sandwich structure has two or more contact elements KE1, KE2 for contacting the varistor VAR and, in an uppermost layer OS, at least one common connection electrode A for electrically contacting a consumer network to be protected.

A first intermediate layer ZS1 made of an electrically insulating layer of material is provided at least in segments between the lowermost layer US and the uppermost layer OS. Such an electrically insulating layer of material can be used, e.g., by means of a circuit board material, a glass fiber mat soaked with epoxide resin, e.g., FR4, or polymers, ceramic or glass.

In the first intermediate layer ZS1 are located the individual fuse DK1, DK2, which are configured such that they can sustain a specified surge current, the specified surge current per fuse being less than the specified surge current of the varistor VAR. That is, although the rating of the individual fuses is small, the required selectivity can be provided by the parallel connection of the fuses, while it can simultaneously be ensured that, as a result of the low rating of the individual fuses, rapid cut-out is provided in the event of a localized fault current and consequently altogether in the event of a general fault current as well.

In this way, the fuses DK1, DK2 are designed as vias within the first intermediate layer ZS1. This makes a low structural height possible.

For this purpose, the fuses DK1, DK2 in the first intermediate layer are in direct electrical contact with the common connection electrode A.

Each of the fuses DK1, DK2 is in direct or indirect electrical contact with a with a subset of the contact elements KE1, KE2. That is, in the embodiment of FIG. 2, the contact element KE1 is in direct contact with the fuse DK1 and the contact element KE2 is in direct contact with the fuse DK2.

In the event of a fault, the fuses DK1, DK2 provide blow-out channels AK in the first intermediate layer ZS1, so that, in the event a fuse DK1, DK2 of the first intermediate layer ZS1 is thermally overloaded, the affected fuse DK1 can vaporize through the blow-out channel, thus interrupting the electrical connection to the underlying (sub-) varistor. In other words, the plasma that develops in the event of a cut-out can pass through blow-out channels AK into an optionally available surrounding extinguishing agent, where the plasma is cooled.

If exactly one fuse DK was allocated to each contact element KE in the embodiment of FIGS. 1 and 2, the advantageous subdivision can also be undertaken with respect to a contact element or, if for example it is not possible to achieve a desired rating with one fuse, this can be achieved through a parallel connection of multiple m fuses $a_1$, $b_2$, . . . , $m_2$ representing a first fuse 1, a parallel connection of multiple fuses $a_2$, $b_2$, . . . , $m_2$ representing a second fuse 2, etc., as is made clear in FIG. 3 in comparison with FIG. 1.

That is, in FIG. 4, each of the fuses DK1, DK2, DK3, DK4 is in direct or indirect electrical contact with a subset of the contact elements KE1, KE2. In other words, in the embodiment of FIG. 4, the contact element KE1 is in direct contact with the fuses $DK1_1$ and $DK1_2$, while the contact element KE2 is in direct contact with the fuses $DK2_1$ and $DK2_2$.

In another embodiment of the invention, seen in FIGS. 7 and 8, a second intermediate layer ZS2 made of an electrically insulating layer of material is provided between the lowermost layer US and of the first intermediate layer ZS1 at least in segments. Such an electrically insulating layer of material can be used, e.g. again by means of a circuit board material, a glass fiber mat soaked with epoxide resin, e.g., FR4, or polymers, ceramic or glass. In addition to the individual layers of material, combination products such as e.g. multi-layer circuit boards or the like can be used here to particular advantage.

In the second intermediate layer ZS2 are in turn located fuses DK3, DK4, which are configured such that they can sustain a specified surge current, the specified surge current per fuse being less than the specified surge current of the varistor VAR. That is, although the rating of the individual fuses is small, the required selectivity can be provided by the parallel connection of the fuses, while it can simultaneously be ensured that, as a result of the low rating of the individual fuses, rapid cut-out is provided in the event of a localized fault current and consequently altogether in the event of a general fault current as well.

In this way, the fuses DK3, DK4 are designed as vias within the first intermediate layer ZS1. This makes a low structural height possible.

The fuses DK3, DK4 in the second intermediate layer are, in turn, in electrical contact with the common connection electrode A by means of at least one via DK1, DK2 of the first intermediate layer ZS1.

Each of the fuses DK3, DK4 of the second intermediate layer ZS2 is in direct electrical contact with a subset of the contact elements KE1, KE2. That is, in the embodiment of FIG. 7, the contact element KE1 is in direct contact with the fuses DK3 and the contact element KE2 is in direct contact with the fuse DK4. In the embodiment of FIG. 8, the contact element KE1 is in direct contact with the fuses DK2 and DK3 and the contact element KE2 is in direct contact with the fuses DK4 and DK5.

In the event of a fault, the fuses DK3, DK4 provide blow-out channels AK in the second intermediate layer ZS2, so that, in the event a fuse DK3, DK4 of the second intermediate layer ZS2 is thermally overloaded, the affected fuse DK3, DK4 can vaporize through the blow-out channel, thus interrupting the electrical connection to the underlying (sub-) varistor. In other words, the plasma that develops in the event of a cut-out can pass through blow-out channels AK and into an optionally available surrounding extinguishing agent, where the plasma is cooled.

In FIGS. 7 and 8, variants corresponding to FIG. 5 of a serial connection of a fuse of a first intermediate layer with a parallel connection of fuses of a second intermediate layer are implemented. The arrangement is not limited to these forms of the serial connections, but rather, a provision can of course be made that parallel connections are provided both in the first intermediate layer and in the second intermediate layer that are connected in series. These measures make it possible to very precisely tune the rating of the individual fuses as well as the rating furnished by the circuit. This principle is illustrated once more very generally in FIG. 9, wherein one possible quasi-spatial alternating arrangement is shown in the lower illustration of FIG. 9, such as can be implemented with for example an intermediate layer. A single fuse can on the other hand be implemented as a parallel connection of fuses, as indicated in FIG. 10.

An exemplary meandering arrangement of such a multi-contact element is shown in FIG. 11. One possible current path is indicated there by the dashed line. A (partial) current of the varistor VAR enters at the contact element KE1 and is fed by means of the via through a third intermediate layer ZS3, which is depicted for the sake of example as insulation for the varistor, and through a second intermediate layer ZS2. At a conductive path location between the first intermediate layer ZS1 and the second intermediate layer ZS2, which can also be embodied in the manner of a fuse, contact to a second via is then established next to that on the right. At a second conductive path location between the third intermediate layer ZS3 and the second intermediate layer ZS2, which can also be embodied in the manner of a fuse, contact to a third via is then established next to that on the right. This process can be implemented as often as necessary in order to achieve the desired rating or the desired voltage. Of course, a provision can also be made that several fuses are connected here in parallel; this would easily be possible e.g. in the sectional perspective shown by repeating the same arrangement in another plane behind it and furnishing at appropriate places a connection of the planes on conductive paths.

As shown in FIGS. 2, 4, 7 and 8, at least a portion of the vias DK1, DK2 of the first intermediate layer ZS1 is connected via conductive paths to the connection electrode A. Through appropriate dimensioning and/or shaping of the conductive paths, the conductive paths can also be configured as additional fuses.

In order to provide additional protection in the event of a fault, a provision can also be made that at least a portion of the blow-out channels AK above the first intermediate layer ZS1 is surrounded by an electrically insulating extinguishing agent. Polyoxymethylene (POM) or quartz sand can for example be used as an electrically insulating extinguishing agent.

In one particularly preferred embodiment, the fuses DK1, DK2 of the first intermediate layer ZS1 as well as the fuses DK3, DK4 of the second intermediate layer ZS2 if present are configured with a rating of up to 10 A, preferably 1 A. It is also advantageous if the surge withstand current is such that currents of up to 1 kA, particularly up to 2 kA or above, can be sustained in the short-term.

As shown in FIG. 12, a provision can also be made that at least one of the fuses DK1, DK2; DK3, DK4 is machined by boring such that the aperture through which current can flow is reduced and the blow-out channel is enlarged. Cut-out values for example can thus be set in a very precise manner by further machining of a via. Moreover, a provision can be made that connections to a connection electrode A are interrupted, for example by means of targeted boring, thus enabling subsequent tuning of the rating. For example, a fuse can be removed from a parallel connection of fuses by reboring.

In order to tune the rating particularly precisely, a provision can be made for example that the bore is eccentric.

As will readily be understood, the invention is not limited only to the multi-contact element but also includes a varistor VAR having at least one multi-contact element MKE. A provision can even be made that both connections of a varistor are equipped with the multi-contact elements according to the invention. The invention can be used in the same way for all connections, even in multi-contact varistors that have recently become available on the market, i.e., those with one or more center taps.

The connection between the multi-contact element MKE and the varistor ceramic VAR is preferably established via a pressure contact. Alternatively or in addition, a soldered, adhesive or clamp connection can also be provided.

The varistor VAR and the multi-contact element MKE are then preferably in a housing G, particularly if an extinguishing agent continues to be used.

Consequently, an arrangement is proposed in which the fuses are disposed substantially parallel to the varistor surface. The fuses can be produced with particular ease using circuit board technology. Multi-layer circuit boards can be used particularly advantageously for this purpose.

Instead of a multi-layer circuit board, a circuit board can also be used that possesses on the underside the contact elements which are connected to the conductive path on the upper side by means of vias. A second circuit board which has no copper coating on its underside and which has recesses and bores is fixed to the lower circuit board so that the recesses are aligned substantially over the (fuse) conductive paths and the bores are aligned at the end thereof. Wires can be bonded, soldered or welded through the bore holes to the end of the fuse conductive paths and then attached to the upper side of the upper circuit board.

For higher levels of voltage, several vias can be connected in series. In the event of large short-circuit currents, these disconnect approximately simultaneously, whereby sufficient counter voltage for cut-out is achieved.

LIST OF REFERENCE SYMBOLS multi-contact element MKE
varistor VAR
contact elements KE1, KE2
uppermost layer OS
common connection electrode A
lowermost layer US
first intermediate layer ZS1
fuse DK1, DK2, DK3, DK4
blow-out channel AK
second intermediate layer ZS2

The invention claimed is:

1. A multi-contact element for a varistor, wherein the multi-contact element has a sandwich structure, wherein the sandwich structure has two or more contact elements in a lowermost layer, and wherein the sandwich structure has at least one common connection electrode in an uppermost layer, wherein a first intermediate layer made of an electrically insulating layer of material is provided between the lowermost layer and the uppermost layer at least in segments, wherein fuses are located in the first intermediate layer that are configured such that they can sustain a specified surge current, the specified surge current per fuse being less than a specified surge current of the varistor, wherein the fuses are embodied as vias within the first intermediate layer, wherein the fuses in the first intermediate layer are in direct electrical contact with the common connection electrode, wherein each of the fuses is in direct or indirect electrical contact with a subset of the contact elements, wherein the fuses provide blow-out channels in the first intermediate layer so that in the event of a thermal overloading of a fuse of the first intermediate layer, the affected fuse can vaporize through the blow-out channel.

2. The multi-contact element as set forth in claim 1, wherein a second intermediate layer made of an electrically insulating layer of material is provided at least in segments between the lowermost layer and the first intermediate layer, wherein further fuses are located in the second intermediate layer and are configured such that the further fuses can sustain a specified surge current, the specified surge current per further fuse being less than the specified surge current of the varistor, wherein the further fuses are embodied as vias within the second intermediate layer, wherein the further fuses in the second intermediate layer are in electrical contact with the common connection electrode by means of at least one via of the first intermediate layer, wherein each of the further fuses of the second intermediate layer is in direct electrical contact with a subset of the contact elements, wherein the fuses provide blow-out channels in the first intermediate layer and in the second intermediate layer so that in the event of a thermal overloading of one of the further fuses of the second intermediate layer, the affected further fuse can vaporize through the blow-out channel.

3. The multi-contact element as set forth in claim 2, wherein the second intermediate layer has a circuit board material.

4. The multi-contact element as set forth in claim 1, wherein the first intermediate layer has a circuit board material.

5. The multi-contact element as set forth in claim 1, wherein at least a portion of the vias of the first intermediate layer is connected to the connection electrode by means of conductive paths, the conductive paths being configured as fuses.

6. The multi-contact element as set forth in claim 1, wherein at least a portion of the blow-out channels is surrounded above the first intermediate layer by polyoxymethylene or quartz sand.

7. The multi-contact element as set forth in claim 1, wherein the fuses have a rating of up to 10 A, preferably 1 A.

8. The multi-contact element as set forth in claim 1, wherein a plurality of fuses are connected in parallel.

9. The multi-contact element as set forth in claim 1, wherein at least one of the fuses is machined by boring such that an aperture through which current can flow is reduced and the blow-out channel is enlarged.

10. The multi-contact element as set forth in claim 9, wherein the bore is eccentric.

11. The varistor having at least one multi-contact element as set forth in claim 1.

12. The varistor as set forth in claim 11, wherein the multi-contact element and the varistor are arranged in a housing.

* * * * *